US008322664B2

(12) United States Patent
Booth

(10) Patent No.: US 8,322,664 B2
(45) Date of Patent: Dec. 4, 2012

(54) SUPPORT DEVICE

(75) Inventor: Robert Booth, South Wingfield (GB)

(73) Assignee: Bridgeshire Packaging Limited, Somercotes, Derbyshire (GB)

( * ) Notice: Subject to any disclaimer, the term of this patent is extended or adjusted under 35 U.S.C. 154(b) by 1064 days.

(21) Appl. No.: 11/908,931

(22) PCT Filed: Mar. 10, 2006

(86) PCT No.: PCT/GB2006/000832

§ 371 (c)(1), (2), (4) Date: Apr. 25, 2008

(87) PCT Pub. No.: WO2006/097686

PCT Pub. Date: Sep. 21, 2006

(65) Prior Publication Data

US 2009/0020663 A1 Jan. 22, 2009

(30) Foreign Application Priority Data

Mar. 18, 2005 (GB) ..... 0505464.8

(51) Int. Cl.
*A47G 23/01* (2006.01)
*A47B 91/00* (2006.01)
*B65D 19/00* (2006.01)

(52) U.S. Cl. ..... 248/152; 248/150; 248/166; 248/174; 206/45.24; 206/600; 108/51.3

(58) Field of Classification Search ..... 248/346.02, 248/346.03, 346.3, 441.1, 450, 459, 469, 248/472, 528, 346.06, 460, 461, 150, 152, 165, 166, 174, 300; 108/51.3, 56.3, 56.1, 108/55.3; 206/757, 746, 45.24, 45.26, 599, 206/600, 756, 271, 273; 229/120.02
See application file for complete search history.

(56) References Cited

U.S. PATENT DOCUMENTS

| | | | | |
|---|---|---|---|---|
| 2,611,569 | A * | 9/1952 | Coleman et al. | 108/51.3 |
| 4,266,386 | A * | 5/1981 | Bains | 52/481.2 |
| 4,445,614 | A * | 5/1984 | Mitsumori et al. | 206/599 |
| 4,714,026 | A * | 12/1987 | Yamaguchi et al. | 108/57.29 |
| 5,377,600 | A * | 1/1995 | Speese et al. | 108/51.3 |
| 5,836,254 | A * | 11/1998 | Johansson | 108/51.3 |
| 6,557,708 | B2 * | 5/2003 | Polacco | 206/774 |
| 2003/0172851 | A1 | 9/2003 | Chen | |

FOREIGN PATENT DOCUMENTS

| | | |
|---|---|---|
| DE | 7338990 | 3/1974 |
| DE | 4140583 A1 | 4/1993 |
| FR | 2775662 A1 | 9/1999 |

* cited by examiner

*Primary Examiner* — Tan Le
(74) *Attorney, Agent, or Firm* — Meyertons, Hood, Kivlin, Kowert & Goetzel, P.C.; Eric B. Meyertons

(57) ABSTRACT

A support device is provided for supporting one or more objects above a ground surface. The device includes a QO body portion and location means associated with the body portion to allow location and/or engagement of one or more objects with the device in use. The body portion has at least one compartment defined therein for containing strengthening means.

25 Claims, 8 Drawing Sheets

SUPPORT DEVICE

Figures 1A, 1B, 1C:
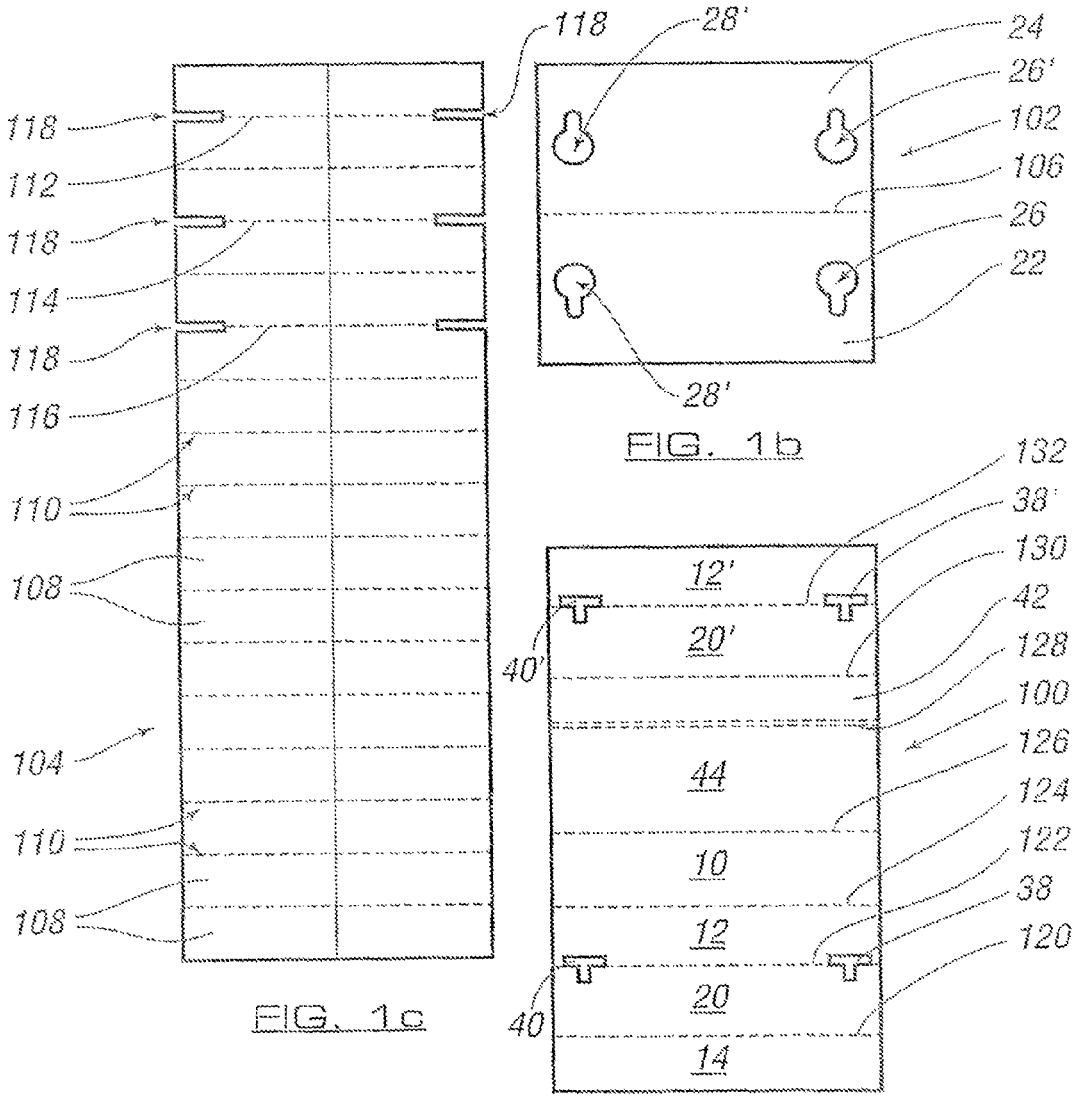

This invention relates to a support device for supporting one or more objects.

Although the following description refers almost exclusively to a support device for supporting one or more objects in the form of a cabinet or item of furniture having one or more protruding members, such as self levelling feet, located on a base thereof, it will be appreciated by persons skilled in the art that the support device of the present invention can be used to support any suitable object above a suitable surface irrespective of whether such feet members or protrusions are present.

It is common to transport one or more items between first and second locations on pallets, such as between a manufacturer's premises and a distributor's premises and/or between different locations in a manufacturer's premises, to allow easy lifting and movement of the same between said locations. Problems associated with the use of pallets are that they are expensive, they are difficult to dispose of after use, they are not recyclable, they take up a large amount of space when not in use and typically different sized pallets are required for different sized objects.

In an attempt to overcome the problems associated with pallets, it is known to use "buffers", on which the objects are supported. A known example of a buffer includes a honey comb structure which is typically formed from board material and is therefore recyclable and inexpensive to manufacture compared to conventional pallets. The honey comb structure is arranged to provide strength to the buffer in a substantially vertical direction. However, such structures typically have poor strength in a substantially horizontal direction and are therefore easily damaged on sustaining an impact in this direction, particularly when being moved around a factory or warehouse environment. Damage to the buffers reduces the aesthetic appeal and strength of the same and is therefore undesirable.

It is therefore an object of the present invention to provide a support device which is inexpensive to manufacture, which has improved strength and rigidity in both horizontal and vertical directions and which overcomes the abovementioned disadvantages of prior art support devices.

It is a further object of the present invention to provide a method of constructing a support device.

According to a first aspect of the present invention there is provided a support device for supporting one or more objects, said device including a body portion and location means associated with said body portion to allow location and/or engagement of said one or more objects with said device in use, said body portion having at least one compartment defined therein and said at least one compartment including or containing strengthening means.

Thus, the support device supports the one or more objects a spaced distance above a surface in which the device is placed in order to prevent damage to the object(s) during transport and/or storage.

The strengthening means provides the support device with sufficient strength and rigidity to allow the device to support one or more objects of different sizes and/or weights. The body portion provides an outer casing covering or enclosing a whole or substantial part of the strengthening means, thereby protecting the strengthening means from damage and improving the aesthetic appearance of the device.

The support device can be located with the object for the purposes of transport, storage and/or during normal use of the object.

In one embodiment, at least the base, top, front and rear surfaces of the strengthening means are enclosed within the body portion. In one embodiment the end portions of the strengthening means are also enclosed within the body portion. Thus, the body portion typically covers the parts of the strengthening means which are most susceptible to damage, such as in a substantially horizontal direction, and thus the front and/or rear of the strengthening means are typically enclosed wholly or partially by the body portion.

In one embodiment the strengthening means includes any or any combination of one or more concertinaed members, corrugated members and/or folded members. These folds, concertinas and/or corrugations are typically substantially vertically arranged to provide strength to the support device in a substantially vertical direction. The concertinaed, corrugated and/or folded members can be formed from board material or other material to provide sufficient strength to the device.

Preferably the strength and rigidity provided by the strengthening means is in a substantially vertical direction. Thus, for example, the concertinas, corrugations or folds are typically arranged in a substantially vertical direction.

In a further embodiment the strengthening means can include one or more blocks of substantially rigid or solid matter. For example, brick like members can be formed from recycled material, such as board waste, sawdust and/or the like which is compressed and/or adhered together to form a substantially solid or rigid block. Alternatively, wooden blocks or blocks of other suitable material can be used to form the strengthening means.

One or more recesses and/or apertures can be provided in the strengthening means to allow an object or part of an object to be located relative to, in or adjacent said strengthening means in use. For example, a recess can be provided adjacent a top front edge of a strengthening block to allow the base of a foot of an object to be located within the body portion without damaging or being damaged by the strengthening block.

In one embodiment the one or more recesses and/or apertures are substantially aligned with the location means provided on or associated with the body portion.

The body portion can be provided with a single compartment in which the strengthening means can be provided or a plurality of compartments can be provided. The compartments can be separated by dividing walls if required. These dividing walls may be inserted into a cavity of the body portion during assembly or can be formed on construction of the blank forming the device.

The location means can include one or more surfaces against which or in which a part or parts of an object to be supported thereon is/are located in use to allow the object to be maintained with the support device in a required position.

In one embodiment the location means are of such a form so as to allow a part of the object being supported, such as one or more feet or leg members associated with the object, to engage therewith or therethrough in use. This prevents the object becoming detached from the support device during transport of the object.

Preferably the location means are provided on at least a top surface of the device.

In this embodiment the location means includes at least one opening in a surface of the device. The opening can be tapered and/or shaped in form to allow a part of the object to be initially located through a larger diameter/dimensioned portion of the location opening and then moved to a narrower diameter/dimensioned portion of the location means communicating with the larger diameter/dimensioned portion to lock the same in position.

Thus, for example, the at least one opening can be of such a shape and/or size to have a first portion in which an object or part of an object can be located in and removed therefrom with relative ease, and a second portion communicating with the first portion which is of such a shape and/or size that when the object or part of the object is located therewith, said object is prevented or cannot easily be removed.

In one embodiment the at least one opening is substantially in the form of a keyhole shape.

Preferably at least one protruding member is provided which protrudes outwardly from an upper surface of the body portion. The location means are typically associated with said protruding member. The protruding member can be integrally formed with the body portion or attached thereto.

Further preferably the at least one protruding member is arranged substantially parallel to a top wall of the device. The protrusion member is typically substantially perpendicular to a front wall of the device.

Preferably at least part of the location means are aligned with the cavity defined in the body portion of the device.

In a further embodiment the location means includes a stop member against which a portion of the object, such as a side of the object, being supported abuts in use.

Preferably the stop member protrudes upwardly from a top or upper wall of the body portion. Further preferably the stop member protrudes in a direction substantially perpendicular to the top wall of the body portion and/or the protruding member having the location means. The stop member is typically substantially parallel to the front/rear walls of the body portion and, in one example, can form part of the rear wall of the body portion.

Preferably reinforcing means are associated with one or more walls of the device. The reinforcing means can include panels which are located adjacent a whole or part of the one or more walls of said body portion.

At least part of the stop member can be provided with a reinforcing panel thereon, typically on an opposite side of the stop member to the at least protruding member or on an outer surface. The reinforcing panel typically acts to provide a cushioning space between adjacent objects. Similar reinforcing panels can be provided on the object if required.

In one example, engagement means are used to engage the object or part of said object against, in or with the location means. For example, the engagement means can include any or any combination of one or more ties, clips, tape, straps, cellophane, VELCRO and/or the like.

Preferably the body portion includes a base, side walls and a top wall and at least one cavity is defined therein. The top wall can be separate to or can include the at least one protruding member. One or more end walls can also be provided if required.

In one example the base of the body portion is formed of such material to allow the same to be slid easily across a surface.

The object being supported may include one or more feet on a base thereof, such as self levelling feet, to allow the object to be provided at a required orientation relative to a surface on which it is to be placed in use. The feet typically locate with the location means of the device.

In use of the device, a support device is typically attached to each end of the object being supported.

The support device and/or strengthening means can be formed from one or more blanks which are assembled to form the final structure.

According to a second aspect of the present invention there is provided a method of forming a support device.

According to further aspects of the present invention there is provided blanks for forming a support device.

According to one aspect of the present invention there is provided a blank for forming a support device for supporting one or more objects when assembled, said blank including a plurality of panels joined together via fold lines, the panels of the blank movable from a flattened condition to an erect condition to define a body portion, location means associated with one or more panels of said blank to allow location and/or engagement of said one or more objects with said device in use, said body portion when assembled defining at least one compartment and said compartment including or containing strengthening means.

The support device is typically formed from such material that can be recycled and/or is biodegradable, such as board material. The support device provides a substantially rigid support for allowing easy transportation and storage of an object. The body portion allows the object to be raised above a ground surface and prevents damage to any leg or feet portions provided on the base or other surface of the object. The location means are formed so as to allow the device to be used with a range of different shaped and sized objects.

Embodiments of the present invention will now be described with reference to the accompanying figures, wherein:

FIG. 1*a* is a blank of the body portion of a support device in one embodiment of the present invention;

FIG. 1*b* is a blank of the protruding member of a support device for location with the body portion in FIG. 1*a;*

FIG. 1*c* is a blank of the folded members forming the strengthening means provided in the cavity formed in the body portion in FIG. 1*a;*

Figure 2A:
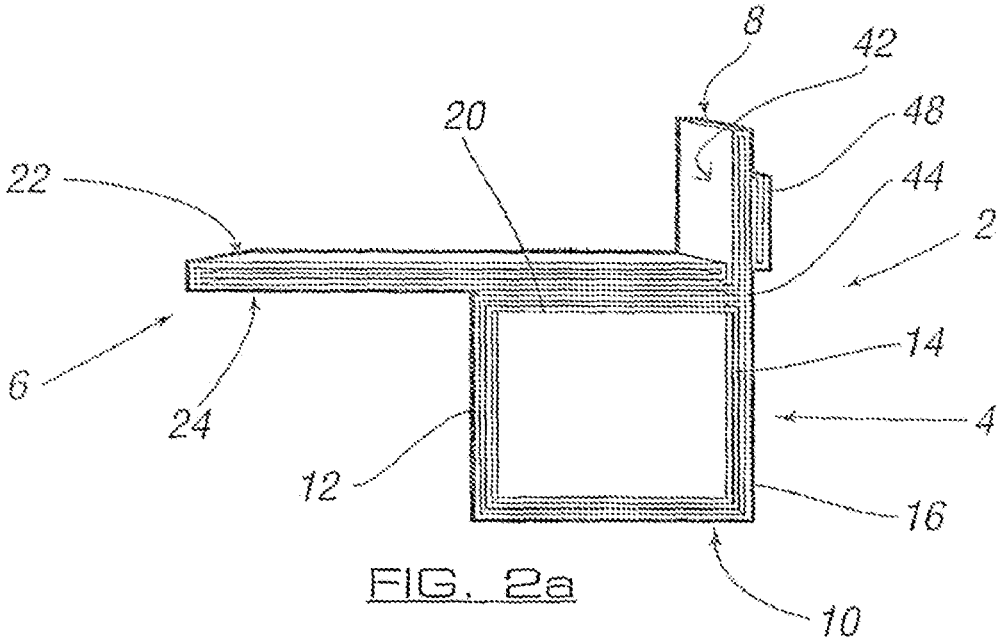
Figure 2B:
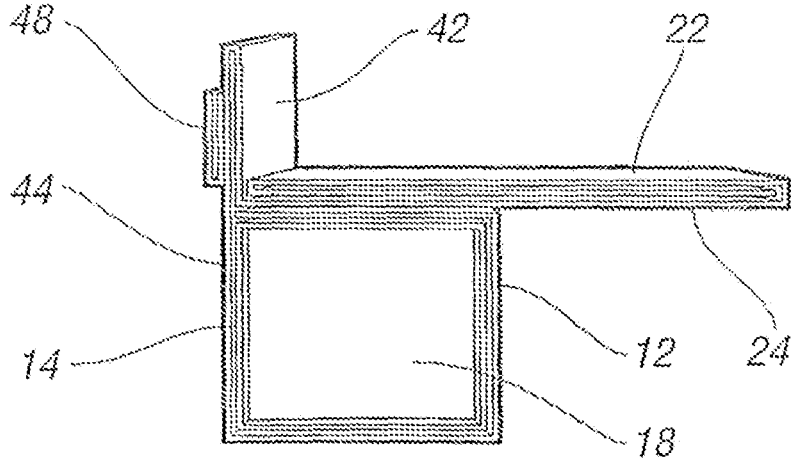
Figure 2C:
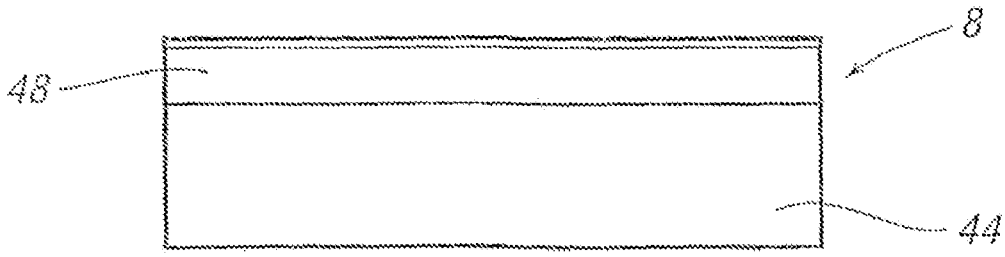
Figure 2D:
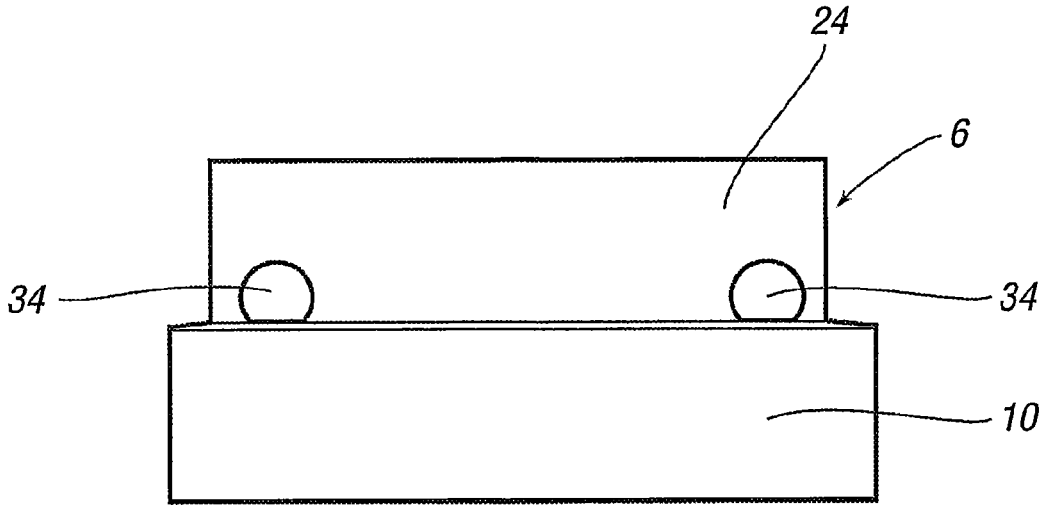
Figure 2E:
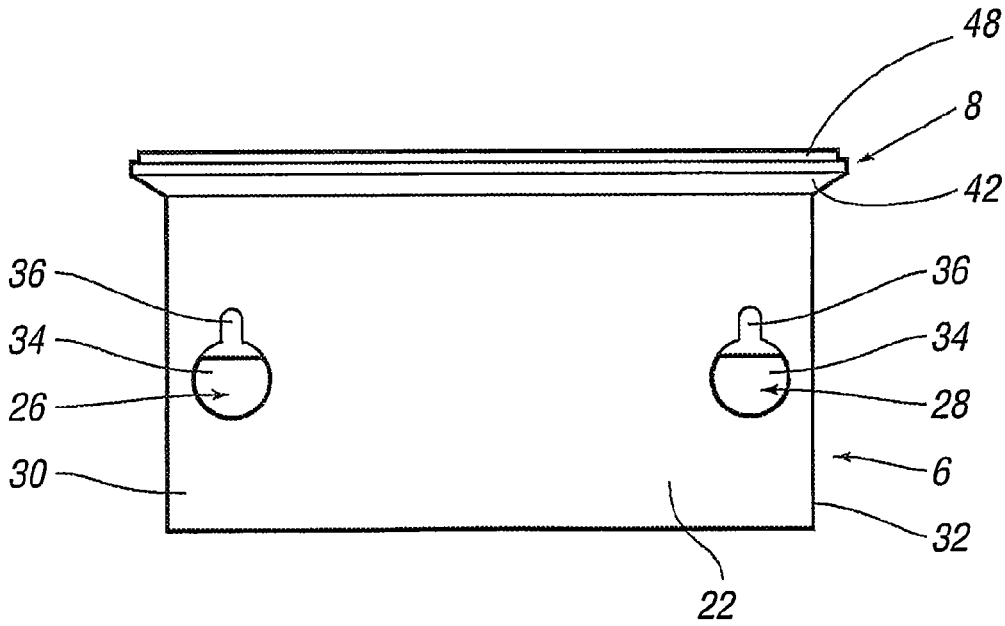
Figure 2F:
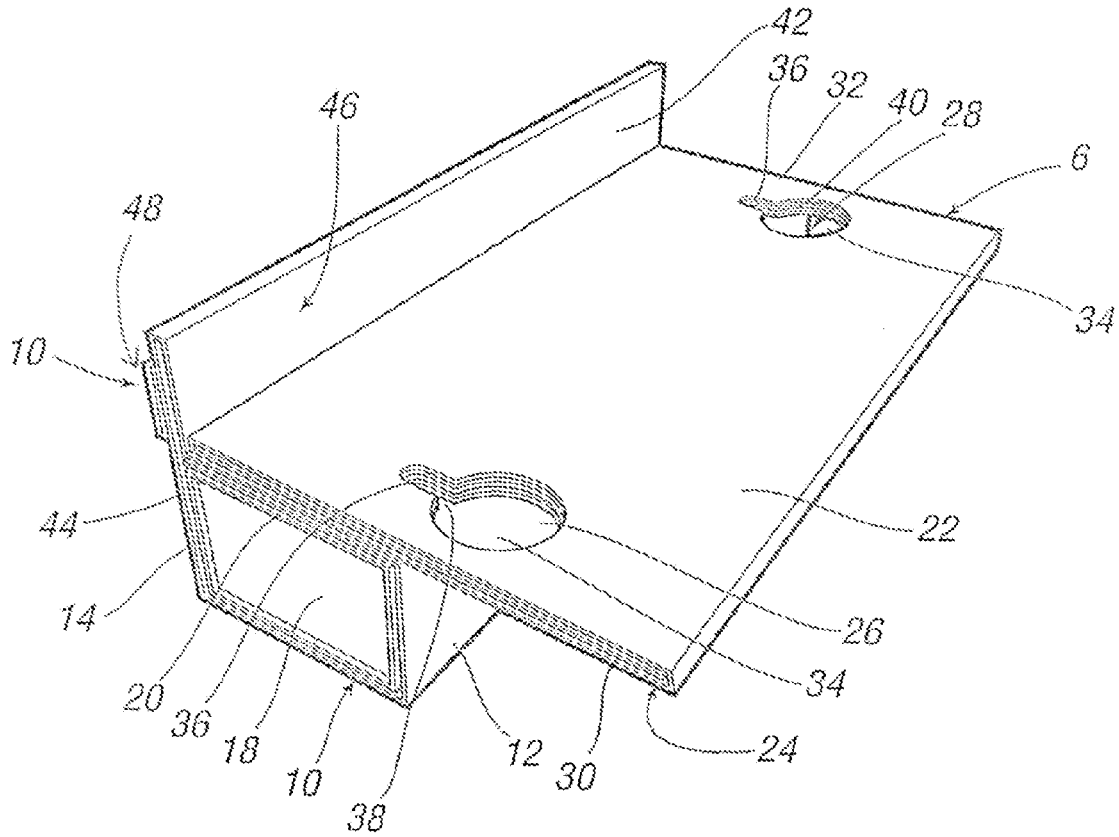
Figure 3A:
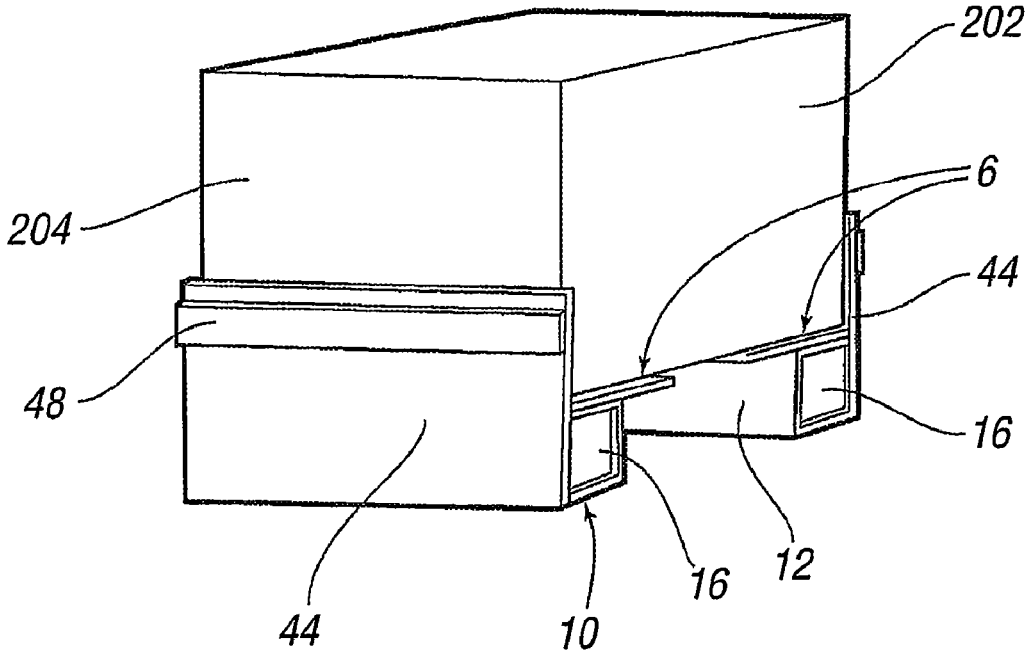
Figure 3B:
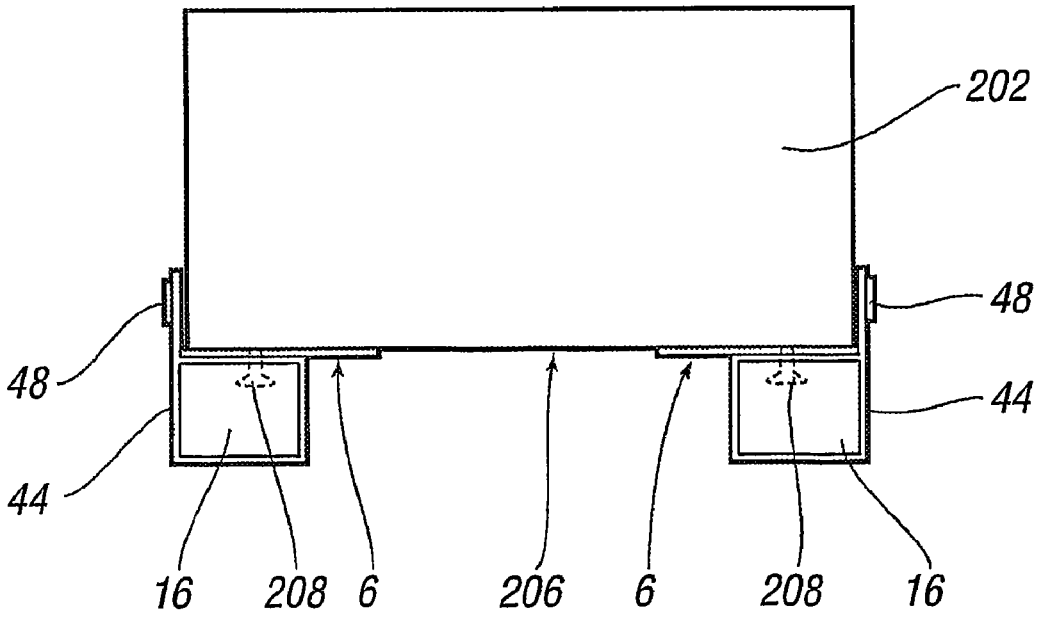
Figure 4:
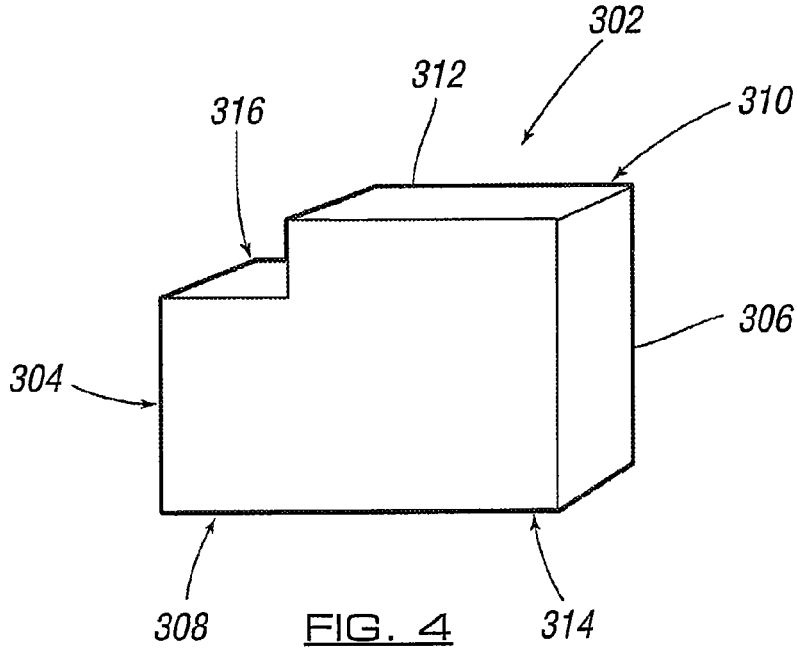
Figure 6:
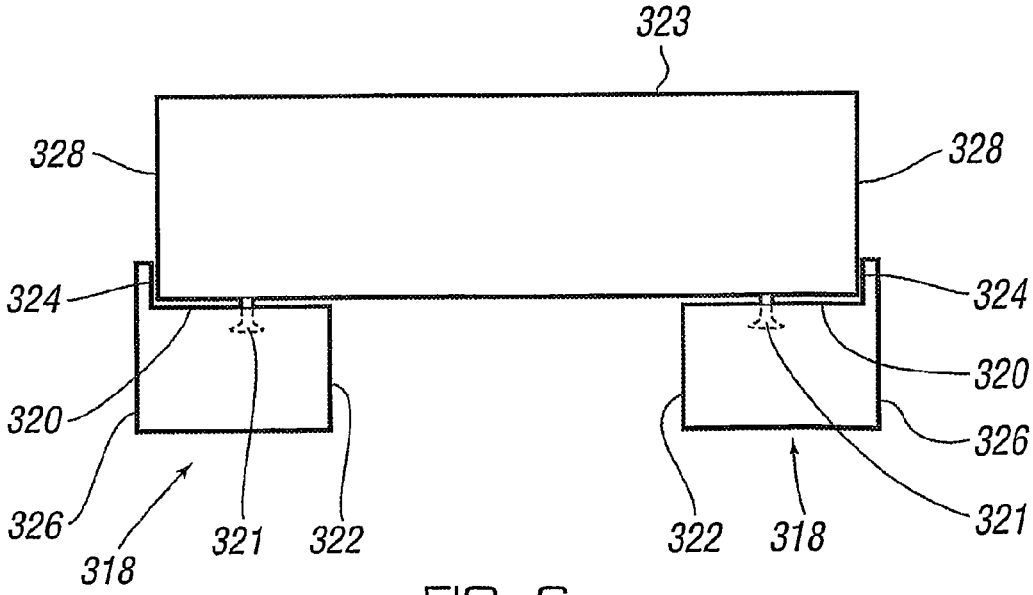
Figure 5A:
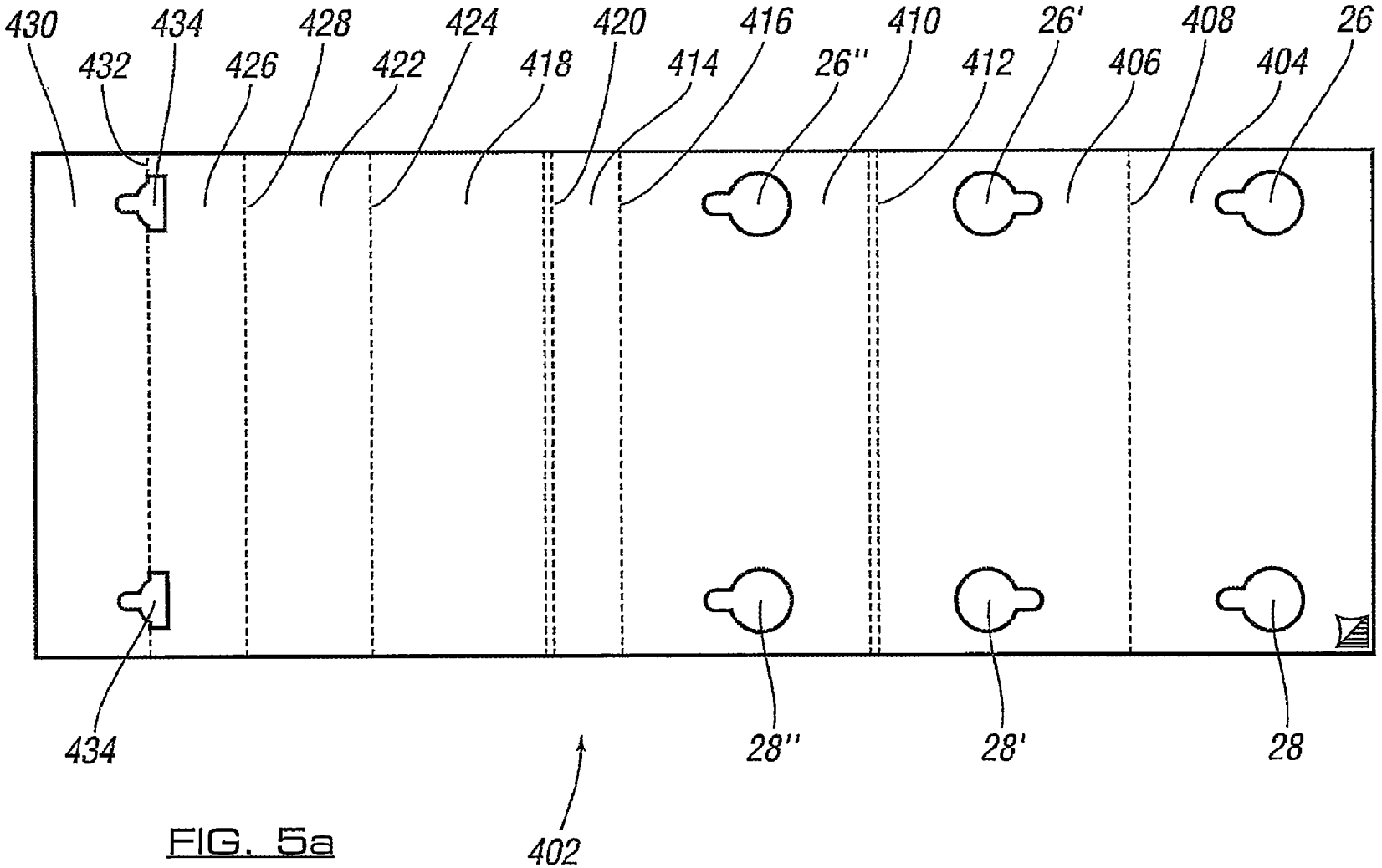
Figure 5B:
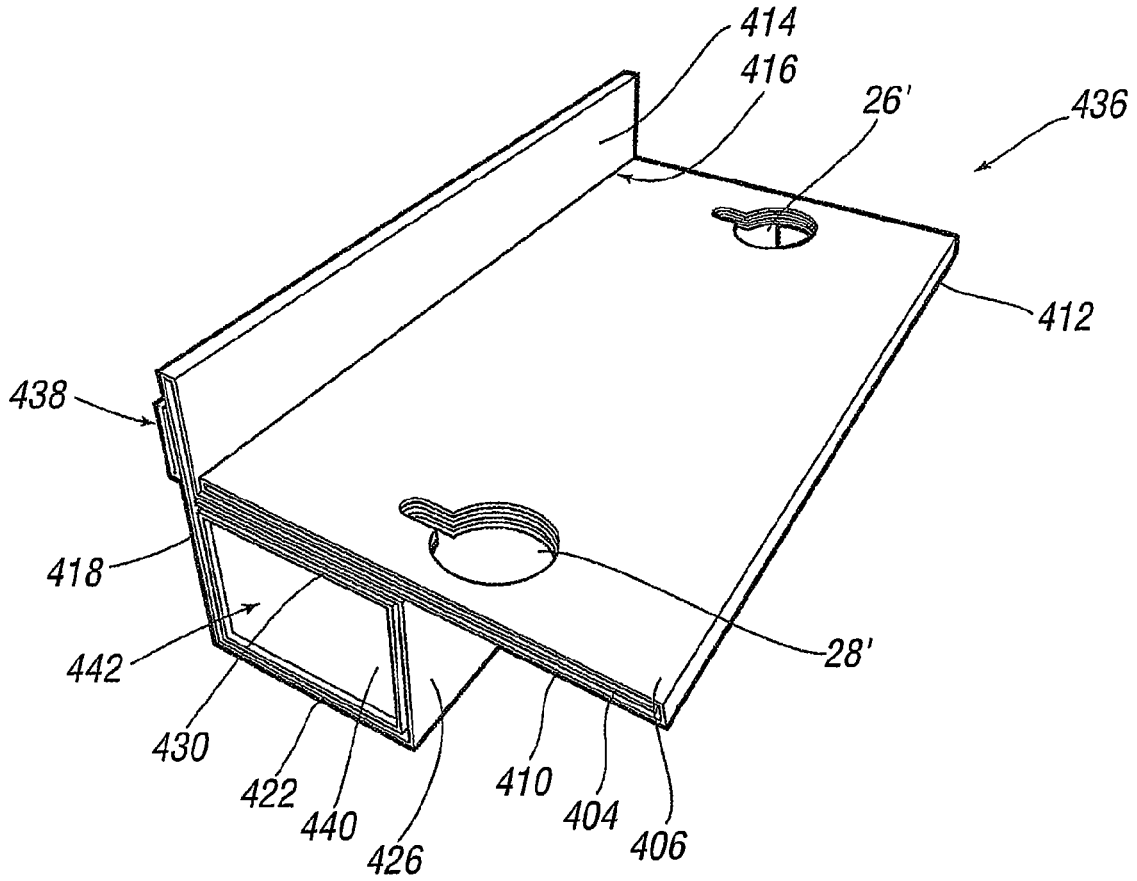

FIGS. 2*a*-2*f* show a right side view, left side view, rear elevation, bottom view, top view and perspective view respectively of a support device formed from the blanks in FIGS. 1*a*-1*c*; and FIGS. 3*a* and 3*b* show a perspective view from the side and a front view of use of support devices on an object in one example;

FIG. 4 illustrates a perspective view of a strengthening block for use in one embodiment of the present invention;

FIG. 5*a* illustrates a single blank for forming the support device shown in FIG. 5*b* according to one embodiment of the present invention; and FIG. 6 is a perspective view of a further example of a support device according to an embodiment of the present invention in use on an object.

Referring firstly to FIGS. 2*a*-2*f*, there is illustrated a support device 2 for supporting an object, such as a cabinet, in use. The support device 2 includes a body portion 4, a protruding member 6 and a stop member 8.

The body portion 4 has a base 10, front side wall 12, rear side wall 14, end walls 16, 18 and a top 20.

Protruding member 6 is substantially planar in form and has an upper surface 22 and a lower surface 24. A part of lower surface 24 engages with top 20 of body portion 4 and the remaining part protrudes outwardly from front side wall 12 of body portion 4. The protruding member 6 is typically provided substantially perpendicular to side wall 12.

Location means in the form of spaced apart and substantially parallel apertures 26, 28 are defined in protruding member 6 adjacent edges 30, 32 thereof. More specifically, apertures 26, 28 are in the shape of a keyhole having a first portion 34 of larger diameter than a second portion 36.

At least the smaller diameter portion 36 is substantially aligned with openings 38, 40 defined in top 20 of body portion 4, and the purpose of this will be described in more detail below.

Protruding member 6 can be provided across substantially the entire length of side wall 12 as illustrated or can be provided across one or more parts thereof. For example, two protruding members can be provided adjacent each end walls 16, 18, each protruding member having location means thereon.

Stop member 8 has a front surface 42 and a rear surface 44. A portion 46 of stop member protrudes upwardly from top surface 20 and is substantially parallel to side wall 14. More particularly, stop member 8 is typically adhered to side wall 14 and is substantially perpendicular to top 20, thereby creating a shoulder portion which will be described in more detail below. The stop member can be provided across the entire length of side wall 14 or can be provided across one or more parts thereof.

A reinforcing panel 48 is provided adjacent a top edge 50 of stop member 8 on rear surface 44. The reinforcing panel can be provided across substantially the entire width of stop member 8 or can be provided across one or more parts thereof.

Referring to FIGS. 1*a*-1*c*, the support device 2 can be formed from a number of blanks 100, 102, 104 which can be assembled in a pre-defined manner. The blanks 100, 102, 104 are typically formed from board material, such as corrugated board or cardboard, although any other suitable material can be used.

Body portion 4 is formed, at least partially, from blank 100 and includes a rear side wall panel 14 joined to a top panel 20 via fold line 120. Top panel 20 is in turn joined to front wall panel 12 via fold line 122. Openings 38, 40 are defined along fold line 122.

Front wall panel 12 is joined to base panel 10 via fold line 124 and base panel 10 is joined to rear stop member panel 44 via fold line 126. Rear Stop member panel 44 is joined to front stop member panel 42 via fold line 128 and front stop member panel 42 is joined to a further top panel 20' via fold line 130. Further top panel 20' is joined to further front wall panel 12' via fold line 132. Openings 38', 40' are defined along fold line 132 and are substantially complementary in shape to openings 38, 40. In construction of the body portion, top panel 20 is located on a suitable surface to temporarily form a base for the body portion and rear side wall panel 14 and front side wall panel 12 are moved perpendicularly thereto by folding said panels along fold lines 120, 122. Rear side wall panel 14 can be moved into abutting relationship to an upright surface (i.e. substantially perpendicular to the surface on which top panel 20 is placed) to keep the same in position. Thus, a substantially U-shaped trough is formed.

End wall panels 16, 18 are then located between front and rear side wall panels at the ends thereof and adhered in place to form an open ended compartment defined between the top panel, end wall panels and front and rear side wall panels. The strengthening means is then located in the compartment. A further dividing wall can be placed in the compartment at this stage if required to provide further rigidity to the structure.

The strengthening means are formed from blanks 104. The strengthening means provide strength and rigidity to the support device 2 in a substantially vertical direction, thereby allowing a heavy object, such as a cabinet, to be located on top of the support device.

Blank 104 includes a plurality of panels 108 separated from each other by fold lines 110 provided substantially transversally to the length of blank 104. The fold lines 110 are typically provided across the entire width of blank 104, with the exception of fold lines 112, 114 and 116 wherein recesses 118 are provided adjacent the edges of the blank.

The panels 108 are folded together in a concertina type of arrangement along fold lines 110 and 116. The folded panels are then located in the formed compartment with recesses 118 located adjacent openings 38, 40. These recesses and the openings allow the self levelling feet of the cabinet to be located therein in use. A plurality of folded blanks 104 can be provided in the compartment so as to provide the required rigidity and strength, the plurality of folded blanks arranged in adjacent relationship to each other.

With the strengthening means in place in the compartment, base panel 10 is then folded over the top of the open end of the compartment via folding along fold line 124. A portion of rear stop member panel 44 which is adjacent fold line 126 is then applied with glue thereon, folded along fold line 126 and adhered to rear panel 14.

Front stop member panel 42 is then folded along fold line 128 and adhered to rear stop member panel 44. Further top panel 20' is folded along line 130 and adhered to top panel 20 and further front wall panel 12' is folded along line 132 and adhered to front wall panel 12. As such, the front, top and rear panels of the body portion are provided of double thickness board material, thereby providing greater strength and rigidity to the body portion compared to single thickness board material. However, it will be appreciated that the body portion can be formed from single thickness board material if required.

With the body portion formed, a part of protruding member 6 is then attached to top panel 20' of body portion 4. Protruding member 6 is formed from blank 102 and includes front panel 22 and a rear panel 24 separated by fold line 106. During assembly, blank 102 is folded along fold line 106 and front panel 22 and rear panel 24 are adhered together, such that openings 26, 28 and 26', 28' provided on the front and rear panels respectively are substantially aligned. Thus, protruding member 6 in this example is formed from two panels joined together to increase the strength of the same. However, it will be appreciated that only a single panel need be provided. Part of rear panel 24 is adhered to top 20 of body portion 4.

The position of the openings 26, 28 and 26', 28' are substantially aligned with openings 38, 40 and 38', 40' in the body portion, thereby allowing the self levelling feet of the compartment to be located therethrough.

The panels of the blanks can be engaged together via adhesive, welding, staples, clips, interlocking members and/or the like.

Referring to FIGS. 3*a* and 3*b*, two support device 2 are provided, one located at either end of the base of a cabinet 202.

The lower ends of side walls 204 of cabinet 202 abut against front panels 42 of stop members 8. The base 206 of the cabinet is supported at either end on protruding members 6 and self levelling feet 208 (shown by dotted lines) are located initially through larger diameter opening 34 and are then locked in place in smaller diameter opening 36 of openings 26 and 28. The recesses 118 provided in the strengthening means allows the feet 208 to pass into the compartment defined in the body portion without obstruction with the strengthening means.

Once the support devices are located in position with the cabinet, wrapping means such as a form of strong plastic or cellophane type material can wound around the cabinet and support means to keep the same in place. The cabinet can now be easily slid across a surface via base 10 of the support devices. In addition cabinet 202 is raised above a ground surface to prevent damage to the base. The strengthening means are encased in the body portion, thereby preventing damage to the same.

Referring to FIG. 4, there is illustrated a further example of strengthening means for use with the support device of the present invention. The strengthening means is in the form of a block 302 formed from shredded waste material, such as waste board material, which is compressed and reformed according to any known process. The block has a front wall 304, rear wall 306, end walls 308, 310, a top wall 312 and a base wall 314. In use, the block 302 is located in the cavity of the body portion of a device, such that front wall 304 is parallel with and adjacent to the front wall of the device, rear wall 306 is parallel with and adjacent to the rear wall of the device etc.

The block 302 can be of a substantially similar size to the interior cavity of the body portion or a block or blocks of any suitable size can be located in any suitable position within the cavity, such as adjacent an end of the body portion.

A recess 316 is defined between the top wall 312 and the front wall 304. This recess is substantially aligned with an aperture forming location means in the body portion to allow the foot of an object to be located therethrough in use. As such, when a foot of the object is located through the aperture, the foot is located in recess 316, thereby preventing damage to the foot or block 302 as a result of the foot being forced against the block 302 when locating the same with a support device.

Referring to FIG. 6, there is illustrated a further example of support devices 318. In this example, the apertures forming the location means through which the feet 321 of object 323 protrude are defined in the top wall 320 of the body portion of the device. There is no portion protruding from the front wall 322 of the device as in the previously described embodiment in which location means are defined. Feet 321 protrude directly into the cavity defined within the body portion in use. Ties (not shown) can be used to engage the device 318 to feet 321 if required. A stop portion 324 can be provided parallel to the rear wall 326 and protruding upwardly and substantially perpendicular to top wall 320 to allow a side wall 328 of the object to abut against the same in use.

Referring to FIG. 5*a*, there is illustrated a single blank 402 for forming a support device similar in appearance to that shown in FIG. 2*f*. The blank 402 includes an intermediate protruding panel member 404 which is joined to a front surface protruding panel member 406 via fold line 408. Location means in the form of keyshaped apertures 26, 28; 26', 28' are defined in panels 404, 406 respectively, the apertures 26, 28 being a mirror image of apertures 26', 28' about line 408. Rear surface protruding panel member 410 is joined to front surface panel member 406 via fold line 412. Apertures 26", 28" are defined in panel 410 and are mirror images of apertures 26', 28'.

Stop member panel 414 is joined to protruding panel member 410 via fold line 416. Rear panel 418 is joined to stop member panel 414 via fold line 420. Base panel 422 is joined to rear panel 418 via fold line 424. Front wall panel 426 is joined to base panel 422 via fold line 428 and top wall panel 430 is joined to front wall panel 426 via fold line 432. Openings 434 are defined between top wall panel 430 and front wall panel 426.

The blank is assembled to construct support device 436 illustrated in FIG. 5*b*. Adhesive is applied to inner surfaces of protruding panel members 404, 406 and 410 and intermediate panel member 404 is folded between and adhered to front surface panel member 406 and rear surface panel member 410. Adhesive is also applied to inner surfaces of stop member panel 414 and rear panel 418 and a rear panel strengthening board 438, which has substantially the same dimensions as rear panel 418, is located on inner surface of rear panel 418. Stop member panel 414 is then folded over and adhered to an end part of the strengthening board 438. Strengthening blocks 440 are then adhered to inner surface of base panel 422 (only one of which is shown for the purposes of clarity). The blocks 440 are typically positioned on base panel 422 adjacent the free ends thereof so as to create end walls of the body portion 442 of the device. Front wall panel 426 is adhered to the front wall of block 440 and top wall panel 430 is adhered to the top of block 440 and to a part of rear surface protruding member panel 410.

When constructed, apertures 26, 26', 26" and 28, 28', 28" are substantially aligned to provide location apertures for the location of one or more support feet on an object being supported by the device. Apertures 26, 28 are also in alignment with openings 434 defined between front wall panel 426 and top wall panel 430 to allow the support feet to sit in the interior of the body portion 442 of the device.

A strengthening board can be attached to the outer surface of base panel 422 if required. It will be appreciated that strengthening boards can be provided/removed if required and/or the blank can be formed so as to include or remove double or triple strengthening panels (i.e. such as replacing the triple layer protruding panel members 404, 406 and 410 with just double layer panel members.)

The construction can be performed manually, can be semi-automated or fully automated as required. Other attachment means other than adhesive can be used to secure the blank in the constructed form, such as one or more staples, clips and/or the like.

The invention claimed is:

1. A support device for supporting an object having a plurality of feet, the support device including:

a body portion comprising a base, a front side wall, a rear side wall and a top defining at least one interior compartment including or containing strengthening means;

a stop member, extending upwardly from the body portion, substantially perpendicular to the top of the body portion and substantially aligned with the rear side wall;

a substantially planar protruding member, protruding outwardly from the body portion, wherein the protruding member is substantially parallel with the top of the body portion and substantially perpendicular to the stop member; and location means in or connected to the body portion to allow location and/or engagement of the object with the support device in use, wherein the location means comprises at least a first and a second opening in the protruding member;

wherein the first opening has a larger diameter or dimensioned portion and a smaller diameter or dimensioned portion communicating therewith, the first opening enabling a first foot of the object to be located initially with the larger diameter/dimensioned portion and moved to the smaller diameter/dimensioned portion, to at least partially lock the object in position in use;

wherein the second opening has a larger diameter or dimensioned portion and a smaller diameter or dimensioned portion communicating therewith, the second opening enabling a second foot of the object to be located initially with the larger diameter/dimensioned portion and moved to the smaller diameter/dimensioned portion, to at least partially lock the object in position in use; and wherein the body portion, the stop member, and the protruding member are comprised of one or more folded blanks.

2. A support device according to claim 1 wherein the body portion covers or encloses a whole or substantial part of the strengthening means.

3. A support device according to claim 1 wherein at least front and rear surfaces of the strengthening means are enclosed or covered by the body portion.

4. A support device according to claim 1 wherein the strengthening means includes any or any combination of one or more concertinaed members, corrugated members or folded members.

5. A support device according to claim 4 wherein the concertinaed members, the corrugated members and/or the folded members are formed from board material.

6. A support device according to claim 4 wherein the folds, corrugations or concertina portions of the members are arranged substantially vertically in the body portion of the device.

7. A support device according to claim 1 wherein the strengthening means includes one or more blocks of substantially rigid and/or compressed material.

8. A support device according to claim 1 wherein one or more recesses and/or apertures are provided in the strengthening means and at least a part of the object is located in or adjacent the one or more recesses and/or apertures in use.

9. A support device according to claim 8 wherein at least one of the recesses and/or apertures is substantially aligned with the at least one opening of location means of the support device.

10. A support device according to claim 1 wherein the location means are provided on at least a top surface of the support device.

11. A support device according to claim 1 wherein protruding member comprises the at least one opening having a larger diameter/dimensioned portion and a smaller diameter/dimensioned portion.

12. A support device according to claim 1 wherein the location means includes at least one further opening in at least one surface of the body portion and a part of the object being supported is located through the at least one opening in the body portion, or engages with the at least one opening in the body portion, in use.

13. A support device according to claim 1 wherein in use a portion of the object being supported abuts against the stop member.

14. A support device according to claim 1, wherein the stop member protrudes upwardly from the top of the body portion.

15. A support device according to claim 1 wherein the stop member forms part of a rear wall of the support device.

16. A support device according to claim 1 wherein engagement means are provided for engaging the object or part of the object with the location means.

17. A support device according to claim 16 wherein the engagement means includes any or any combination of one or more ties, clips, tape, straps, cellophane or VELCRO.

18. A support device for supporting an object having a base and a plurality of feet, the support device including:

a body portion comprising a base, a front side wall, a rear side wall and a top defining at least one interior compartment including or containing strengthening means;

a stop member, extending upwardly from the body portion, substantially perpendicular to the top of the body portion and substantially aligned with the rear side wall;

a substantially planar protruding member, for at least partially supporting the base of the object, protruding outwardly from the body portion, wherein the protruding member is substantially parallel with the top of the body portion and substantially perpendicular to the stop member: and location means in or connected to the body portion to allow location and/or engagement of the object with the support device in use, wherein the location means comprises at least a first and a second opening in the protruding member;

wherein the first opening has a larger diameter or dimensioned portion and a smaller diameter or dimensioned portion communicating therewith, the first opening enabling a first foot of the object to be located initially with the larger diameter/dimensioned portion and moved to the smaller diameter/dimensioned portion, to at least partially lock the object in position in use and position the first foot on the strengthening means;

wherein the second opening has a larger diameter or dimensioned portion and a smaller diameter or dimensioned portion communicating therewith, the second opening enabling a second foot of the object to be located initially with the larger diameter/dimensioned portion and moved to the smaller diameter/dimensioned portion, to at least partially lock the object in position in use and position the second foot on the strengthening means; and wherein the body portion, the stop member, and the protruding member are comprised of one or more folded blanks.

19. A support device for supporting an object having a plurality of feet, the support device including:

a body portion comprising a base, a front side wall, a rear side wall and a top defining at least one interior compartment containing or including at least one block;

a stop member, extending upwardly from the body portion, substantially perpendicular to the top of the body portion and substantially aligned with the rear side wall;

a substantially planar protruding member, protruding outwardly from the body portion, wherein the protruding member is substantially parallel with the top of the body portion and substantially perpendicular to the stop member;

at least a first and a second opening in the protruding member, the first and second openings being associated with the body portion to allow location and/or engagement of the object with the support device in use;

wherein the first opening has a larger diameter or dimensioned portion and a smaller diameter or dimensioned portion communicating therewith, the smaller diameter/dimensioned portion being aligned with the at least one block, wherein the first opening enables a first foot of the object to be located initially with the larger diameter/dimensioned portion and moved to the smaller diameter/dimensioned portion, to at least partially lock the object in position in use;

wherein the second opening has a larger diameter or dimensioned portion and a smaller diameter or dimensioned portion communicating therewith, the smaller diameter/dimensioned portion being aligned with the at least one block, wherein the second opening enables a second foot of the object to be located initially with the larger diameter/dimensioned portion and moved to the smaller diameter/dimensioned portion, to at least partially lock the object in position in use; and wherein the body portion, the stop member, and the protruding member are comprised of one or more folded blanks.

20. A support device as claimed in claim 1, wherein the object has a base, and the substantially planar protruding member is arranged to at least partially support the base of the object in use.

21. A support device as claimed in claim 1, wherein the strengthening means is arranged to support, in use, the foot of the object positioned in the smaller diameter/dimensioned portion.

22. A support device as claimed in claim 21, wherein the foot is positioned on the strengthening means.

23. A support device as claimed in claim 1, wherein the base of the body portion is substantially parallel to the top of the body portion, and substantially perpendicular to the front side wall and the rear side wall.

24. A support device as claimed in claim 1, wherein the object comprises a side wall, different from the plurality of feet, and wherein, in use, the stop member is arranged to abut against the side wall of the object.

25. A support device as claimed in claim 19, wherein the at least one block is arranged to support, in use, the foot of the object positioned in the smaller diameter/dimensioned portion.

* * * * *